United States Patent [19]

Ljungström et al.

[11] Patent Number: 4,790,123

[45] Date of Patent: Dec. 13, 1988

[54] METHOD AND A MACHINE FOR THE MANUFACTURING OF PACKING CONTAINERS

[75] Inventors: Tommy Ljungström, Höör; Anders Sjöström, Lund, both of Sweden

[73] Assignee: AB Tetra Pak, Lund, Sweden

[21] Appl. No.: 910,675

[22] Filed: Sep. 23, 1986

[30] Foreign Application Priority Data

Oct. 3, 1985 [SE] Sweden ..... 8504574

[51] Int. Cl.[4] ..... B65B 43/26; B65B 43/44; B65B 43/56

[52] U.S. Cl. ..... 53/458; 53/202; 53/563; 53/565

[58] Field of Search ..... 53/168, 201, 202, 457, 53/458, 546, 565; 141/178, 129, 186; 198/339.1, 570

[56] References Cited

U.S. PATENT DOCUMENTS

| | | | |
|---|---|---|---|
| 2,628,010 | 2/1953 | Ray et al. . | |
| 3,486,423 | 12/1969 | Mistarz | 53/565 |
| 3,785,113 | 1/1974 | Martensson et al. | 53/565 |
| 4,269,516 | 5/1981 | Kopp et al. | 53/202 |
| 4,493,687 | 1/1985 | Bernle . | |
| 4,510,732 | 4/1985 | Lothman . | |

*Primary Examiner*—Horace M. Culver
*Attorney, Agent, or Firm*—Burns, Doane, Swecker & Mathis

[57] ABSTRACT

A method and machine for the manufacture of packing containers of the type where a number of packing container blanks are successively converted to packing containers, open at the top, which are filled with contents, shaped and sealed. The packing container blanks are advanced intermittently during the processing and filling between the different stations, which means especially in packing machines with several conveying elements, that the driving unit of the machine will be unevenly loaded and that the working of the machine will be uneven and jerky. To overcome this it is proposed in accordance with the invention, that the driving of the different conveying elements sould take place asynchronously in accordance with a similar but mutually offset pattern of movement. The one conveying element (6') will then be substantially at standstill during the advance of the second conveying element (6'') and vice versa, as a result of which the driving unit obtains an appreciably more uniform torque curve so that uneven operaton and consequent wear and noise can be prevented.

8 Claims, 3 Drawing Sheets

METHOD AND A MACHINE FOR THE MANUFACTURING OF PACKING CONTAINERS

FIELD OF THE INVENTION

The present invention relates generally to packing containers and, more particularly, to a method for the manufacture of filled and closed packing containers and to a packing machine comprising conveying elements for the transport of packing containers between different stations for filling, closing and other processing.

BACKGROUND OF THE INVENTION

In the manufacture of packing containers for different types of contents methods and machines are used which convert packing material to finished packing containers, which are filled with the desired contents and closed. In the foodstuff industry, especially in the packaging of dairy products such as milk and the like, machines are used which convert packing container blanks in web or sheet form (possibly partly preformed and provided with opening arrangements or the like), fill them with the required quantity of contents and close them in liquid-tight manner.

A known machine (U.S. Pat. No. 3,785,113) for carrying out this process consists of a first part for the conversion of the packing container blanks to fillable packing containers and a second part for the filling and sealing and possibly final shaping of the packing containers. The first part comprises magazines for prefabricated packing container blanks, mandrel wheels on which the blanks are placed, and sealing and forming elements so as to form a liquid-tight base on each packing container blank. Subsequently the blanks are transferred to the second part of the machine and, more particularly, to conveyors which by means of intermittent advance move the blanks between different processing stations where they are filled with contents, the tops are formed and they are closed.

Machines of this type can provide the desired capacity if they are given the desired number of conveyors or production lines (mandrel wheels and conveyors) and, beside the said example with two production lines, it is also possible in larger machines to use three, four or even more production lines. This is done in that the desired number of production lines is placed parallel in a joint machine frame, each production line being provided with all parts associated with the production lines. However, generally a common electric and control system together with a common driving unit are employed.

When a packing machine of this type with two or more jointly driven production lines is used, however, certain disadvantages make themselves felt. Since each production line is driven intermittently, so that the packing containers transported in the conveyors are momentarily stopped at each station for filling, closing etc., an extremely varying load will be placed on the driving unit of the machine, and when the machine comprises two or more production lines arranged in parallel which are driven jointly in cycle with each other, these varying loads will become so great that they not only cause disadvantages in the form of increased power requirement, noise etc., but also bring about greatly increased wear of the driving unit and make necessary an appreciable overdimensioning of the same. The intermittent driving of all production lines in cycle with each other also means that the different processing stations will operate in cycle and thus cause substantial peaks in their requirement of electric power, hot air and the like.

OBJECTS AND SUMMARY OF THE PRESENT INVENTION

It is an object of the present invention to provide a method for the manufacture of packing containers which overcomes the said disadvantages, and which in spite of the occurrence of intermittent driving movements gives a largely balanced requirement of energy input compared with known methods.

These and other objects have been achieved in accordance with the invention in that a method of the type described earlier has been given the characteristic that the conveying elements are driven asynchronously, the processing stations along the one conveying element being activated alternately with the processing stations along the second conveying element and in cycle with the intermittent driving of the respective conveying element.

A preferred embodiment of the method in accordance with the invention has been given, moreover, the characteristics which are evident from dependent claim 2.

It is a further object of the present invention to provide a packing machine wherein two or more conveyors are driven by means of a joint driving unit in such a manner that the load on the driving unit will be as even as possible, as a result of which the energy requirement as well as the dimensions of the components included can be minimized.

It is a further object of the present invention to provide a packing machine of the type mentioned earlier, wherein the driving and movement patterns are designed so that loads, vibrations and noise are reduced by comparison with earlier packing machines.

These and other objects haved been achieved in accordance with the invention in that a packing machine of the type described in the introduction has been given the characteristic that the machine comprises two intermittently drivable conveying elements, each with its set of stations, these conveying elements being connected to a source of driving powerand adapted to be driven in accordance with a similar, but mutually offset pattern of movement.

Preferred embodiments of the packing machine in accordance with the invention have been given, moreover, the characteristics which are evident from dependent claims 4–8.

BRIEF DESCRIPTION OF THE DRAWING

A preferred embodiment of the method as well as of the machine in accordance with the invention will now be described in greater detail with special reference to the attached schematic drawings which only show the details indispensable for an understanding of the invention.

DETAILED DESCRIPTION OF THE PREFERRED EMBODIMENT

Figure 1:
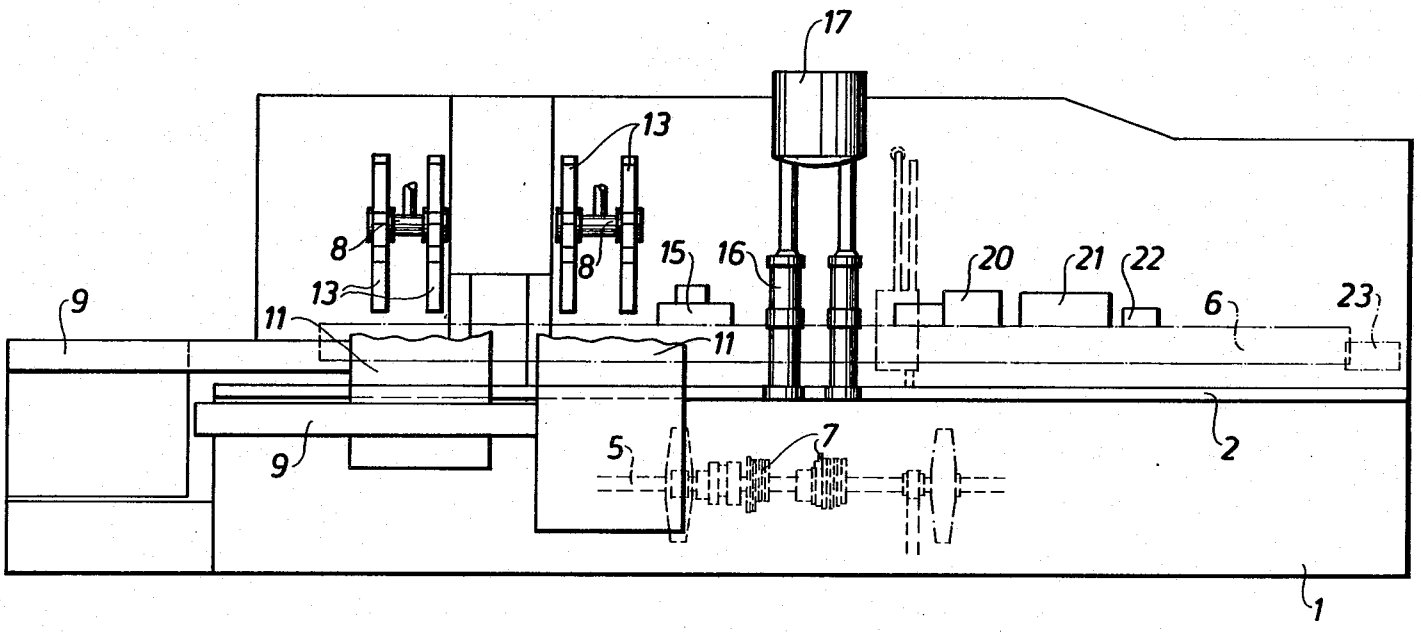
FIG. 1 is a side schematic view partly in section of the different main components in a packing machine according to the invention.
Figure 2:
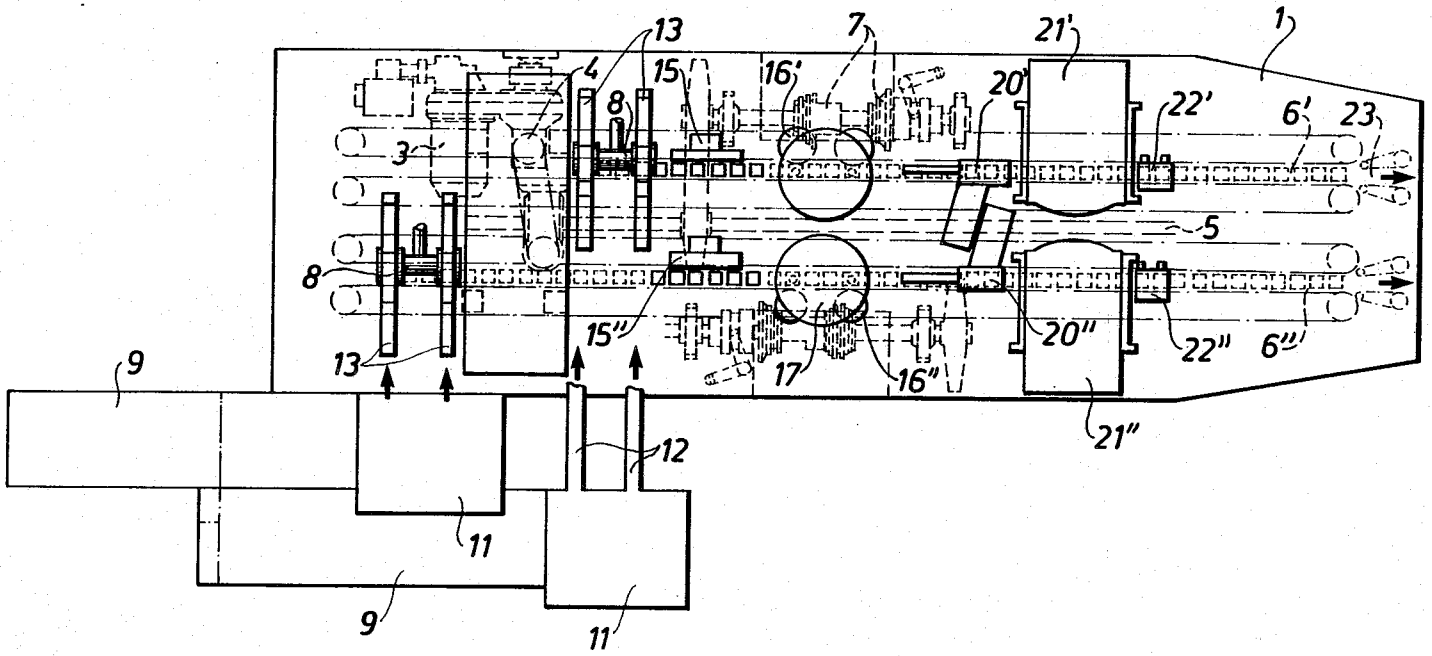
FIG. 2 is a top view of the packing machine in accordance with FIG. 1 from the top.

The machine in accordance with the invention, similarly to the machine described in the above mentioned U.S. patent, is made up of a frame 1 which comprises a horizontal plate 2. Underneath the plate are the driving unit of the machine, its electric system, lubricating system and other conventional parts necessary for the operation. The driving unit, beside the motor 3, comprises an indexing gear box 4 which, beside converting the continuous rotation of the motor 3 to an indexing movement, transfers the movement to the movable parts of the machine. Thus the indexing gear 4 is connected to a driving shaft 5 located centrally in the machine which in turn drives two conveyors 6 extending parallel and being situated above the frame plate 2. The driving shaft 5 is , moreover, in a driving connection with a number of cam plates 7 from which a system of arms and rods (not shown) transfers the movement to a number of processing stations situated along the conveyor 6, which will be explained in greater detail in the following. From the indexing gear 4 extends further a vertical transmission element (not shown) which drives a number of mandrel wheels 8 mounted so that they can rotate in the machine frame. The driving unit, which for the most part is conventional, also comprises further power takeoffs for lubricating oil pumps, compressed air pumps or the like which, however, are not important for an understanding of the invention and consequently are not described in greater detail in this connection. The driving unit as a whole is accomodated in a space situated underneath the plate 2 of the frame.

Above the frame plate 2 are the conveying elements for the packing container blanks and a number of different elements for the shaping, filling or other processing of the individual packing containers. The upper part of the machine may be roughly divided into a first part, situated to the left in the figures, wherein the packing container blanks are converted and prepared for receiving the contents, and a second part, situated to the right in the figures, wherein the contents are supplied and the packing containers are completed and closed. The packing containers are of a known type,e.g. so-called roof-ridge type, and comprise a carrier layer of e.g. paper, which is coated on both sides with liquid-tight and heat-sealable thermoplastic layers. The blanks are divided by means of crease lines into different panels for container body, top and bottom parts and sealed to tubular shape and laid flat. However, this is wholly conventional and is not important for the invention.

Figure 3:
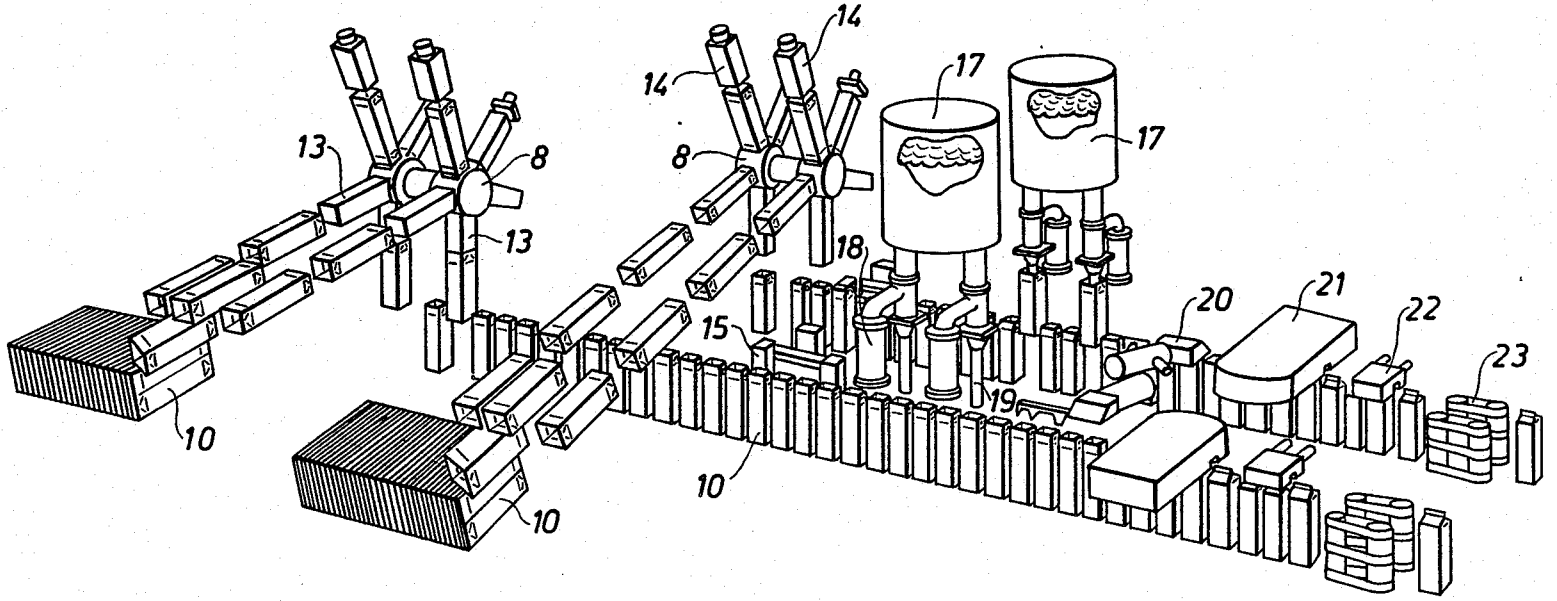
FIG. 3 is a perspective schematic view of the stepwise manufacture of packing containers in a machine according to the invention.

The first part of the machine comprises two magazines 9 situated outside the actual frame 1, which are adapted to receive in batches a number of packing container blanks 10 (FIG. 3), which are placed manually or automatically into the magazine where they are successively moved to the right in the Figures to the raising unit 11. The raising units raise the individual packing container blanks 10 laid flat so that they become tubular and obtain a substantially square cross-section. With the help of feeders 12 the tubular packing container blanks 10 subsequently are transferred to mandrels 13 situated momentarily in line with the feeders 12, these mandrels 13 being supported in star-shape by the mandrel wheels 8 mentioned earlier, adapted to be rotated in steps. Each mandrel wheel usually is doubled and co-operates then also with double feeders 12. Thus, naturally, also two packing containers will be handled simultaneously at any one time which, however, is understood by implication and, for the sake of clarity, will not be described in greater detail in this description. This also means that all the subsequent processing elements (fillers, top-formers etc.) are of the twin-type (doubled) which, however, is well-known and, therefore, will not be described in detail. When the packing container blank has been placed in position on the mandrel, the mandrel wheel is turned one step, as a result of which the projecting end of the packing container blank will be placed right opposite a hot air blower 14 which heats the thermoplastic layer of the projecting material to softening temperature. Thereafter the mandrel wheel is turned a further step and the heated projecting base lugs are folded together and compressed with simultaneous cooling so that a liquid-tight sealed container base is produced. Through further turning of the mandrel wheel the packing containers will then be placed vertically on top of one or the other of the two conveyors 6, and thus the handling of the packing container blank in the first part of the machine is concluded.

The two chain conveyors 6 mentioned earlier, serving as conveying elements for the packing containers, extend in longitudinal direction of the machine parallel with one another and with the underlying driving shaft 5. Each conveyor 6 comprises two endless conveyor chains which are provided with carriers and between them form spaces or compartments, the size of which corresponds to the size of the packing containers. The number of mandrel wheels may vary as a function of the size of the machine, but each conveyor 6 is associated with one (double) mandrel wheel 8 and extends with its one end straight under (parallel with) the axis of rotation of the mandrel wheel. From each mandrel wheel the packing containers now are transferred to the underlying conveyor 6 by being moved vertically downwards to the vacant compartment of the conveyor. Directly after the packing containers have been placed in correct position into the conveyor, the intermittent advance of the same is recommenced and the conveyors move the packing containers step by step forward to the processing stations mentioned previously which are arranged along the conveyor. After it has been moved over a certain distance in the conveyor, the actual packing container, open at the top, approaches the first processing station, which is a top-prefolder 15, whose task consists in prefolding the top panels of the packing container in the direction towards the final, sealed position, so that the material in the crease lines situated between the panels is softened up and the subsequent completion of the top is facilitated. After the prefolding, the top panels of the packing containers are in a slightly folded-in position, but the packing containers continue to be open when they approach the following station, which comprises a filler 16 and a contents tank 17. The fillers, like the mandrel wheels 8, may be doubled and comprise two filling units, each with a metering pump 18 and a filling pipe 19. The packing container to be filled is raised upwards by means of an arrangement, not shown, when it is right underneath the filling pipe, until the lower end of the filling pipe is inside the packing container and approaches the bottom of the same. Subsequently the metering pump 18 is activated and the desired volume of contents is supplied to the container at the same time as the same is moved vertically downwards again to its previous position in the conveyor 6. By this manoeuvre the contents are prevented from frothing and hindering the subsequent forming and closing of the top part of the packing container. After the filling the packing container is transported further with the help of the conveyor 6 to the following station, which comprises a top heater 20 which by means of hot air heats the thermoplastic material on the parts of the projecting top lugs of the packing container which are to be sealed to each other. After heating to the melting temperature of the thermoplastic layer the packing container is shifted further to the subsequent station, which comprises a top sealing arrangement 21 which folds together and compresses the heated top lugs so that a liquid-tight seal is produced. After completion of the sealing the packing container is transferred by means of the conveyor 6 to a dating device 22 which provides the top part of the packing container with the required date stamping or other marking. Hereafter the packing container is finished and can be discharged from the conveyor 6 and the packing machine with the help of delivery arrangements which transfer the packing containers to a conveyor belt, not shown.

As mentioned earlier the driving of the machine takes place with the help of the driving unit whose motor 3 via the indexing gear 4 drives the central driving shaft 5 which in turn drives the conveying elements 6 and the different processing stations. In order to overcome the problems mentioned in the introduction (uneven driving torque curve, jerky operation, beat, impacts and noise) which affect to a greater or lesser extent the packing machines of this type with several lines known up to now, the different elements in the packing machine in accordance with the invention are driven asynchronously. Thus the intermittent advancing of the two conveying elements 6 does not occur simultaneously, but according to an offset movement pattern which essentially means that the one conveying element 6' is at standstill whilst the second conveying element 6'' is moved. This asynchronous driving of the conveying elements 6 brings about automatically that the processing stations 15', 16', 20', 21', 22' along the one conveying element are activated alternately with the processing stations 15'', 16'', 20'', 21'', 22'' along the second conveying element and in cycle with the intermittent driving of the respective conveying elements 6',6''. As a result e.g. the filling element 16 in the one conveying element will be active whilst the opposite filling element is inactive, and the top heater 20 in the one conveying element is active at the same time as the corresponding top heater is inactive. This alternating activation of the different processing stations implies an appreciable saving of power and energy, since in principle each pair of processing stations (arranged right opposite one another in the respective conveyors) can be continuously supplied with energy, as the latter is conducted alternately to each of the stations included in the pair. In previous packing machines, momentarily, very large amounts of energy are required, since all stations in both (all) conveyors are activated simultaneously. At the same time the size of the source of energy or driving force can be reduced appreciably, since the stations alternately utilize a common source of driving power. This advantage is particularly noticeable where the top heaters 20 are concerned which previously required, momentarily, large amounts of hot air, which owing to the inertia of the system had to be produced also in between the occasions of usage and then meant a net loss of energy. In the machine in accordance with the invention the hot air can be distributed alternately between the two top heaters 20', 20'' so that energy losses owing to inactive top heaters practically can be completely avoided. In a similar manner the supply of contents to the fillers 16 can be simplified by making them operate alternately,so that the supply pipe can be utilized more effectively, and likewise the pumps, valves and other parts are given smaller dimensions.

The intermittent driving of the two conveying elements is done with the help of the indexing gear 4 which is of a conventional kind driving two outgoing shafts in similar pattern of movement, but mutually offset by 180°. This secures great accuracy at the alternate advancing of the two conveying elements 6. The two cam packs 7 will obtain via the driving shaft 5 a pattern of movement, offset in corresponding manner, which through the driving via the driving shaft 5 is wholly synchronized with the intermittent advance of the respective conveying element. The intermittent torsional movement of the two mandrel wheels 8 too is synchronized of course with the movement of the corresponding conveying element 6,so that the transfer of packing container blanks from the mandrels 13 to the conveying elements 6 can take place without any difficulty. However, this belongs to prior art and need not be described in more detail in this context.

Since the two conveying elements and elements associated with them are permanently connected with the common source of driving power in inactive as well as in active position, the loading of the driving motor 3 will be equalized so that the conspicuous peaks, which occur in moment curves in machines with synchronously driven conveying elements, are considerably reduced. Likewise the total power requirement is reduced, since the retardation of the one conveying element will contribute to the simultaneous acceleration of the second conveying element, as a result of which a smaller driving unit can be used, with consequent reduction of energy consumption, noise etc. In machines with two conveying elements these are connected to the source of driving power appropriately with an offset by 180°, whilst in the case of several conveying elements these can be distributed in some other manner.

While this invention has been illustrated and described in accordance with a preferred embodiment, it is recognized that variations and changes may be made and equivalents employed therein without departing from the invention as set forth in the claims.

What is claimed is:

1. In a method for the manufacture of filled and closed packing containers along two production lines on which the packing containers are advanced intermittently by means of two conveying elements between different processing stations, the improvement comprising:

continuously driving an electric drive motor;

advancing the conveying elements asynchronously by operatively connecting the conveying elements to the continuously driven motor in a mutually offset pattern such that one of the conveying elements is operatively connected to the continuously driving motor while the other conveying element is operatively disconnected therefrom and the other conveying element is operatively connected to the continuously driving motor while the one conveying element is operatively disconnected therefrom; and activating the processing stations along one of the conveying elements alternately with the processing stations along the other of the conveying elements and in cycle with the intermittent driving of the respective conveying element.

2. A method in accordance with claim 1, wherein different pairs of processing stations are provided each including one processing station positioned along one of the conveying elements and another processing station positioned along the other of the conveying elements and wherein energy is supplied continuously to each pair of processing stations, said energy being conducted alternately to each of the stations included in the pair.

3. In a packing machine including conveying elements for the transport of packing containers between different stations for filling, closing and other processing, the improvement comprising:

two intermittently drivable conveying elements each arranged along a separate set of the different stations;

an electric driving motor adapted to be continuously driven during the intermittent driving of the conveying elements; and at least one indexing gear box connecting said electric driving motor to the conveying elements, said conveying elements being adapted to be driven according to a similar but mutually offset intermittent pattern of movement.

4. In the packing machine in accordance with claim 3, the improvement further comprising said at least one indexing gear box being provided with intermittent connection means for intermittently connecting said conveying elements to said electric motor during the continuous rotation of the motor to cause the similar but mutually offset intermittent pattern of movement of said conveying elements.

5. A machine in accordance with claim 3, wherein the conveying elements are in the form of elongated conveyors which are mutually parallel.

6. A machine in accordance with claim 3, wherein the different stations are arranged in pairs directly opposite each other on the respective conveyor.

7. A machine in accordance with claim 6, wherein the stations in a pair of stations can be activated alternately by means of a common source of energy.

8. A machine in accordance with claim 6, wherein a pair of stations comprises elements for the supply of contents to the packing containers, the stations in the pair being alternately connectable to the source of contents.

* * * * *